US005200756A

United States Patent [19]

Feller

[11] Patent Number: 5,200,756

[45] Date of Patent: Apr. 6, 1993

[54] THREE DIMENSIONAL MICROSTRIP PATCH ANTENNA

[75] Inventor: Walter Feller, Airdrie, Canada

[73] Assignee: NovAtel Communications Ltd., Calgary, Canada

[21] Appl. No.: 695,279

[22] Filed: May 3, 1991

[51] Int. Cl.[5] ..... H01Q 1/38

[52] U.S. Cl. ..... 343/700 MS; 343/846

[58] Field of Search ..... 343/700 MS, 846, 829, 343/789

[56] References Cited

U.S. PATENT DOCUMENTS

| | | | |
|---|---|---|---|
| Re. 29,911 | 2/1979 | Munson | 343/700 MS |
| 3,346,865 | 10/1967 | Jones, Jr. | 343/708 |
| 4,101,895 | 7/1978 | Jones, Jr. | 343/708 |
| 4,117,489 | 9/1978 | Kaloi | 343/700 MS |
| 4,125,837 | 11/1978 | Kaloi | 343/700 MS |
| 4,125,838 | 11/1978 | Kaloi | 343/700 MS |
| 4,162,499 | 7/1979 | Jones, Jr. et al. | 343/700 MS |
| 4,163,236 | 7/1979 | Kaloi | 343/700 MS |
| 4,326,203 | 4/1982 | Kaloi | 343/700 MS |
| 4,736,454 | 4/1988 | Hirsch | 455/129 |
| 4,853,703 | 8/1989 | Murakami et al. | 343/700 MS |
| 4,907,006 | 3/1990 | Nishikawa et al. | 343/700 MS |
| 4,992,799 | 2/1991 | Garay | 343/700 MS |
| 5,061,938 | 10/1991 | Zahn et al. | 343/700 MS |

FOREIGN PATENT DOCUMENTS 17059 1/1989 Japan .

OTHER PUBLICATIONS

Arai and Goto, "Patch Antenna on Sphere of Broad Beamwidth", Proceedings of ISAP '89, Aug. 23, 1989.

Luk and Tam, "Wraparound Patch Antenna on a Spherical Body", Proceedings of ISAP '89.

*Primary Examiner*—Rolf Hille

*Assistant Examiner*—Hoanganh Le

*Attorney, Agent, or Firm*—Cesari and McKenna

[57] ABSTRACT

An antenna assembly comprises a dome-like substrate with a ground plane layer on the interior surface of the substrate and a radiative patch on the outer surface of the substrate. The cavity defined by the substrate is closed off by a base having a conductive layer that is connected to the ground plane layer, thereby to isolate the cavity and circuit elements that may be disposed therein. Preferably the substrate has a polyhedral form and the radiative patch is a polygon having apex portions that extend down over the side surface of the substrate to enhance the sensitivity of the antenna at low elevations.

11 Claims, 3 Drawing Sheets

THREE DIMENSIONAL MICROSTRIP PATCH ANTENNA

FIELD OF THE INVENTION

This invention relates generally to antennas and more specifically to a microstrip antenna assembly that includes both an antenna and signal conditioning circuitry that processes signals received by the antenna.

BACKGROUND OF THE INVENTION

A conventional microstrip antenna is generally planar and comprises an antenna element in the form of a conductive layer on one side of a dielectric substrate layer, and a conductive ground layer on the opposite side of the substrate.

Antennas of this type are advantageous in a number of applications because of their relatively low profile and ease of manufacture, as well as their compatibility with other components implemented in microstrip configurations.

In prior microstrip antennas, the propagation pattern may be substantially independent of azimuth at high elevation angles, that is, for radiation directions that do not depart greatly from the normal. At low elevations, on the other hand, the sensitivity of the same antenna may be largely dependent on azimuthal direction and, in some cases, the antenna is insensitive in all such directions at low elevations. An example of this characteristic is a circularly polarized microstrip antenna which, in prior convention configurations, has reasonable sensitivity with the desired polarization only at elevations that are relatively close to the normal.

However, for a number of applications, the antenna must function effectively over a wide range of elevation angles and, in particular, it is necessary that the antenna function at relatively low angles. An example of such an application is an antenna used with a Global Positioning System receiver. The receiver will ordinarily receive circularly polarized signals simultaneously from a number of earth-orbiting satellites having a wide range of instantaneous elevations.

Receiving antennas usually function in conjunction with signal conditioning circuit components such as phase shifters, filters, and amplifiers that may also be arranged in microstrip configurations. The present invention relates in part to an assembly of a microstrip antenna and these auxiliary circuit components in a compact form to facilitate the use of the assembly in small transportable equipment. An example of such equipment is a receiver for receiving and processing signals transmitted by the satellites in the Global Positioning System.

It is therefore an object of this invention to provide a microstrip antenna that is sensitive to circularly polarized signals over a wide range of elevation angles.

Another object is to provide an antenna assembly that has a relatively low cost and provides adequate shielding of auxiliary components from the environment.

An antenna assembly embodying the invention comprises a microstrip antenna having a dome-like configuration and a substrate, carrying the signal conditioning components associated with the antenna, attached to and closing off the interior of the dome structure. A radiative patch extends over and down from the top surface of the substrate. The signal conditioning components, which are thus disposed within the interior of the dome structure, are interconnected by microstrip conductors. The ground plane for this microstrip circuitry is connected to a metallic lining on the interior surface of the dome structure which serves as the "ground plane" for the antenna. These two ground planes thus effectively completely enclose the signal conditioning circuitry and thereby effectively shield it from the exterior of the assembly.

The dome structure preferably has a polyhedral configuration, specifically a truncated pyramid, with side surfaces facing in various azimuthal directions. The radiative patch is preferably rectangular, with corner portions extending down over the side surfaces. These corner portions are, in effect, circularly polarized subantennas having substantial sensitivity at low elevations. Consequently, the overall antenna exhibits good sensitivity to circularly polarized signals over a wide range of elevations and in all azimuthal directions.

This arrangement provides for a compact, easily manufactured assembly. Moreover, the assembly is rugged and the components thereof are protected from electromagnetic interference and environmental stress, which makes the assembly highly useful for a number of applications including the Global Positioning System receivers mentioned above.

BRIEF DESCRIPTION OF THE DRAWINGS

FIG. 2A top view of the printed circuit board base of the antenna assembly of FIG. 1A;

DETAILED DESCRIPTION OF ILLUSTRATIVE EMBODIMENTS

Figure 1A:
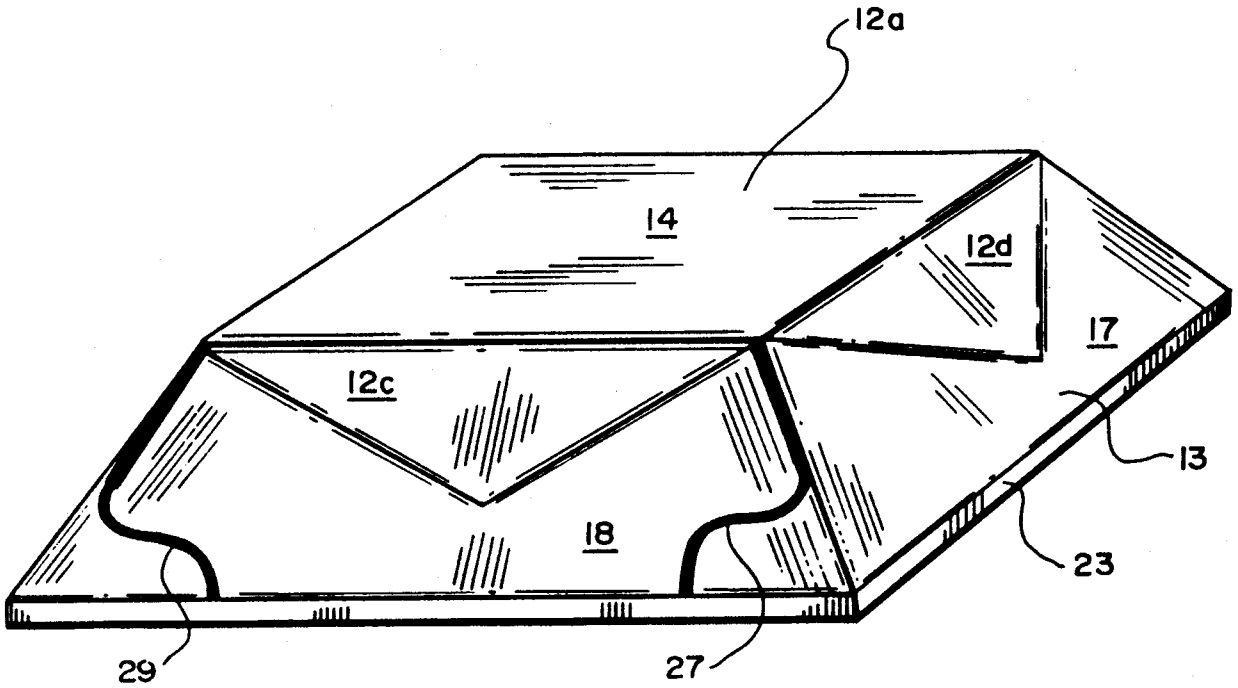
FIG. 1A is an isometric view of an antenna assembly embodying the comprising an antenna assembled with a printed circuit board base.
Figure 1C:
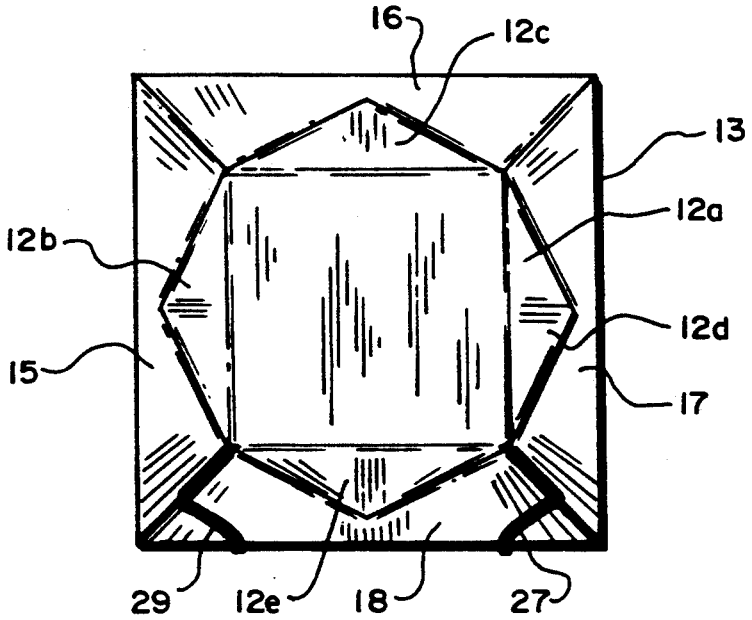
FIG. 1C is top view of the antenna assembly of FIG. 1A.
Figure 1B:
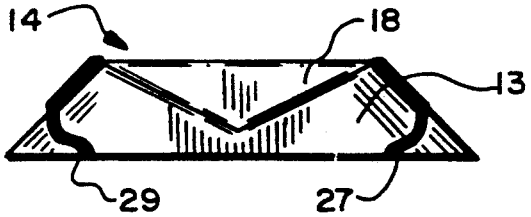
FIG. 1B is a side view of the antenna assembly of FIG. 1A.

As shown in FIGS. 1A-1C, an antenna assembly incorporating the invention comprises an antenna element in the form of a conductive layer 12, disposed on a dome-shaped dielectric substrate 13. The substrate 13 preferably has a polyhedral configuration, specifically a truncated pyramid having a top surface 14 and sloping side surfaces 15-18.

Figure 1D:
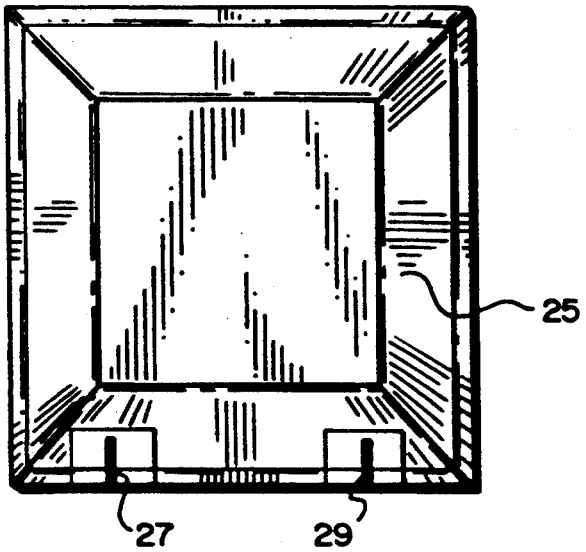
FIG. 1D view of the antenna used in the assembly.

FIG. 1D shows the interior of the substrate 13. The inner surface of the substrate is covered with a metallic layer 25 that serves as a ground "plane" for the antenna and also as a shield for components housed in the interior of the dome as described below. The layer 25 extends beneath the lower edge of the substrate.

Figure 2A:
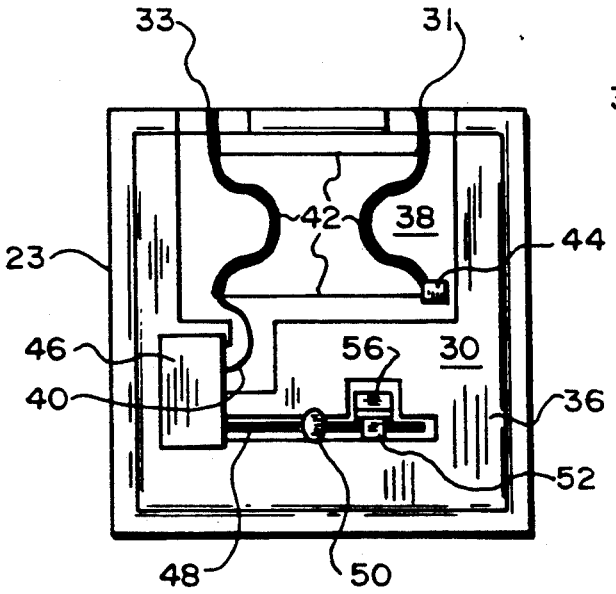

Returning to FIGS. 1A-1C, the antenna element 12 comprises a central portion **12*a* that, in the illustrative embodiment, covers the substrate top surface 14. The element 12 also includes wing portions 12*b*-12*e* that extend down along the side surfaces 15-18. As best seen in FIG. 1C, the layer 12 is an essentially square patch whose corners have, in effect, been folded down on the substrate side surfaces 15-18. The dimensions of the square are such as would be used for a conventional planar patch antenna that is fed at the midpoints of two of its edges for circular polarization. Thus, as also shown in FIGS. 1A-1C, feed conductors 27 and 29** extend from the junctures Of wing portions 12*d* and 12*e*, and 12*e* and 12*b*, respectively, to the lower edge of substrate surface 18 and then under the edge to gaps in the ground plane layer 25 (FIG. 1D). They thus contact conductive pads 31 and 33 on the top surface of a base 23 (FIG. 2A).

Figure 2B:
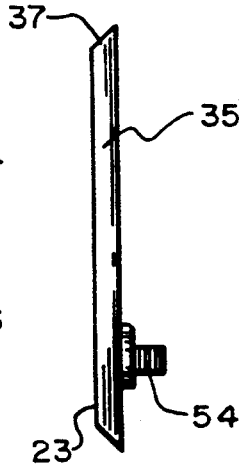
FIG. 2B is an edge view of the base.

As shown in FIG. 2, the base 23 has a microstrip configuration. The bottom surface (FIG. 2B) is covered with a groundplane conductor 35. The top surface is covered with a conductive layer 36 except in those areas containing signal and power conductors. This layer is in contact with the ground plane layer 25 of the substrate 13. The conductive layers 35 and 36 are connected together by a layer 37 (FIG. 2B) that extends around the edges of the base 23.

The pads 31 and 33 are connected to a phase shifter 38 in the form of a square hybrid which combines the signals from the pads and applies the resultant signal to a conductor 40. Each of the legs 42 has an electrical length of one-quarter wavelength. Thus the electrical distances from the pads 31 and 33 to the conductor 40 differ by one-quarter wavelength and the phase shifter thereby provides a 90° relative phase shift to the signals received from the antenna conductor 12 (FIG. 1A) by way of the pads 31 and 33. The phase shifter also includes a resistive termination 44 at the remaining corner of the hybrid to prevent undesirable reflections from that corner.

With this arrangement, the antenna exhibits sensitivity to circularly polarized signals over a wide range of elevations and, in particular, at materially lower elevations than planar patch antennas. Moreover, the entire assembly is compact and of low cost, and it provides effective shielding of the components contained therein from the environment.

With further reference to FIG. 2A, the conductor 40 connects to a narrow-band filter 46 mounted on the base 23. The output of the filter 46 is applied to a conductor 48, which feeds the filtered signal from the antenna to an amplifier indicated at 50. The output of the amplifier 50 is coupled through a capacitor 52 to a connector 54 extending through the base 23. The connector, in turn, delivers the RF signal to the demodulation and signal processing elements (not shown) of a receiver incorporating the antenna assembly.

The connector 54 also provides power for the amplifier 50, the DC path to the amplifier including a resistor 56 in parallel with the capacitor 52.

Figure 3:
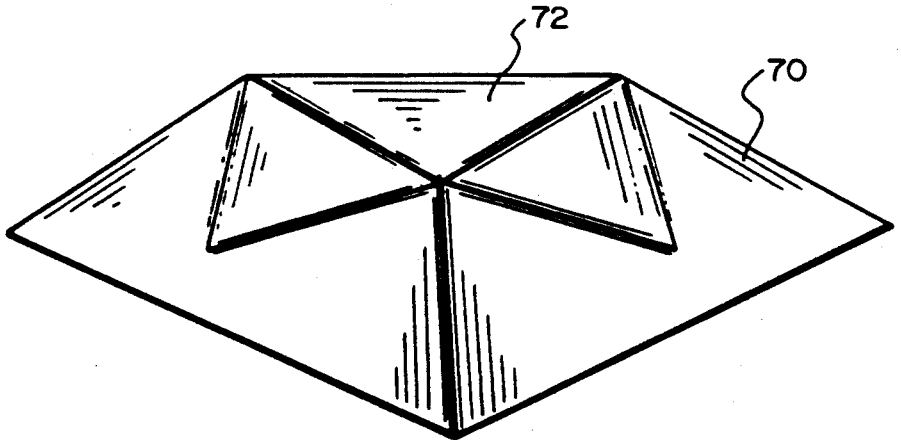
FIG. 3 is an isometric view of an alternative embodiment of the invention.

FIG. 3 depicts another variation of the invention. In this case the polyhedral dome 70 is a truncated tetrahedron. The antenna layer 72 is essentially a triangular patch that covers the top surface of the dome, with the apices of the patch extending down over the side surfaces. In all other respects, the antenna assembly of FIG. 3 is like that of FIGS. 1 and 2. Thus the antenna layer 72 connects to feeders (not shown) that provide circular polarization.

The foregoing description has been limited to specific embodiments of this invention. It will be apparent, however, that variations and modifications may be made to the invention, with the attainment of some or all of its advantages. Therefore, it is the object of the appended claims to cover all such variations and modifications as come within the true spirit and scope of the invention.

What is claimed is:

1. An antenna assembly comprising:

A. a dome-like substrate having a surface with a top portion and side portions extending from said top portion, said side surface portions defining an opening opposite said top surface portion;

B. a ground plane layer on the interior surface of said substrate;

C. a radiative layer on the exterior surface of said substrate, said radiative layer having a central portion on said top surface portion and apex portions extending from said top surface portion and down over the side surface portions; and D. a base contacting said substrate and closing said opening, said base having a first surface facing the interior of said substrate and a second surface opposite said first surface.

2. The assembly defined in claim 1 in which said base includes a conductive layer on said second surface and means electrically connecting said conductive layer to said ground plane layer, thereby to electrically isolate the volume bounded by said substrate and said base.

3. The assembly of claim 2 including:

A. feed means comprising a conductor disposed on said substrate and connected to said radiative layer for conductive signals to or from said radiative layer, B. circuit means including conductors disposed on said first surface of said base and connected to said feed means for processing signals received by said antenna assembly.

4. The antenna assembly defined in claim 3 further including means connected to said feed means to provide a circular polarization characteristic for said radiative layer.

5. The assembly defined in claim 2 including:

A. feed means including first and second conductors disposed on said substrate and connected to said radiative layer, B. conductors in the form of a hybrid disposed on said first surface of said base, and C. signal conditioning components disposed within said interior of said substrate and connected to operate on signals received by said radiative layer and passed through said hybrid, D. means connecting said hybrid to said first and second conductors to provide a circular polarization characteristic for said antenna assembly.

6. An antenna comprising:

A. a domelike polyhedral substrate having top and side surfaces,

B. a groundplane layer on the interior surface of said substrate, and

C. an antenna element on the exterior surface of said substrate, said antenna element being a polygonal patch having a central portion on said top surface and apex portions extending from said central portion down over side surfaces of said substrate.

7. The antenna of claim 6 in which:

A. said substrate is a truncated pyramid having a rectangular top surface and

B. said patch is rectangular.

8. The antenna of claim 6 in which:

A. said substrate is a truncated tetrahedron having a triangular top surface and B. said patch is triangular.

9. The antenna of claim 6 further comprising a base contacting said substrate and closing the interior thereof, said base having a first surface facing the interior of said substrate and a second surface opposite said first surface.

10. The antenna of claim 9 including a conductive layer on said second surface and means electrically connecting said conductive layer to said ground plane layer, thereby to electrically isolate the volume bounded by said substrate and said base.

11. The antenna defined in claim 10 including:

A. feed means including first and second conductors disposed on said substrate and connected to said radiative layer, B. conductors in the form of a hybrid disposed on said first surface of said base, and C. signal conditioning components disposed within said interior of said substrate and connected to operate on signals received by said radiative layer and passed through said hybrid, D. means connecting said hybrid to said first and second conductors to provide a circular polarization characteristic for said antenna.

* * * * *